US005944895A

United States Patent [19]

Maetani et al.

[11] Patent Number: 5,944,895

[45] Date of Patent: Aug. 31, 1999

[54] PROCESSING LIQUID APPLICATION SYSTEM FOR USE IN AN APPARATUS FOR TREATING A CORD FOR USE IN A POWER TRANSMISSION BELT

[75] Inventors: Masakastu Maetani; Shinji Kotani; Haruyuki Tsubaki; Takashi Masuda, all of Hyogo, Japan

[73] Assignee: Mitsuboshi Belting Ltd., Hyogo, Japan

[21] Appl. No.: 08/810,085

[22] Filed: Mar. 3, 1997

[51] Int. Cl.[6] ..... B05C 3/12

[52] U.S. Cl. ..... 118/420; 118/429

[58] Field of Search ..... 118/420, 693, 118/694, 429, 689; 226/104

[56] References Cited

U.S. PATENT DOCUMENTS

| | | | |
|---|---|---|---|
| 2,154,057 | 4/1939 | Thielking . | |
| 3,124,206 | 3/1964 | Burke | 177/116 |
| 5,221,879 | 6/1993 | Taniguchi et al. . | |
| 5,350,981 | 9/1994 | Taniguchi et al. . | |

FOREIGN PATENT DOCUMENTS

| | | | |
|---|---|---|---|
| 906154 | 7/1944 | France | 118/694 |
| 0672252 | 7/1979 | U.S.S.R. | 118/694 |
| 89/09847 | 10/1989 | WIPO | 118/694 |

*Primary Examiner*—Brenda A. Lamb
*Attorney, Agent, or Firm*—Wood, Phillips, VanSanten, Clark & Mortimer

[57] ABSTRACT

An apparatus for treating a cord for use in a power transmission belt. The apparatus has a guide system for guiding a cord in a predetermined path and a processing liquid application system including a receptacle for a discrete amount of a processing liquid. A container defines a reservoir for a supply of processing liquid. There is a discharge opening on the first container for communicating processing liquid from a supply of processing liquid in the first container reservoir to the receptacle. With a first predetermined amount of processing liquid in the receptacle, the predetermined path extends through the processing liquid in the receptacle. With the discharge opening blocked, the first container reservoir is air tight. A first structure is provided for mounting the first container in an operative position on the apparatus wherein processing liquid in the first container reservoir flows by gravity to the discharge opening. With the first container in the operative position and a second amount of processing liquid in the receptacle, the processing liquid in the receptacle blocks the discharge opening on the first container to thereby stop gravitational flow of processing liquid from the first container reservoir to the receptacle. With the first container in the operative position and a third predetermined amount of processing liquid that is less than the second predetermined amount of processing liquid in the receptacle, the discharge opening is unblocked so that processing liquid from the first container reservoir flows through the discharge opening until the processing liquid accumulates in the receptacle to the point that the processing liquid blocks the discharge opening to thereby stop flow of processing liquid through the discharge opening to the receptacle.

13 Claims, 9 Drawing Sheets

PROCESSING LIQUID APPLICATION SYSTEM FOR USE IN AN APPARATUS FOR TREATING A CORD FOR USE IN A POWER TRANSMISSION BELT

BACKGROUND OF THE INVENTION

1. Field of the Invention

This invention relates to apparatus for continuously treating a cord that can be incorporated into a power transmission belt and, more particularly, to a processing liquid application system through which processing liquid is continuously applied to the cord.

2. Background Art

It is known to use load carrying cords in all types of power transmission belts, i.e. V-belts, V-ribbed belts, toothed belts, etc., and particularly those used in industrial applications. Typically, the cords are made from fiber material, such as polyester fiber, aramid fiber, glass fiber, and the like. To improve adhesion with the belt rubber, it is known to pretreat the fiber cords. For example, it is known to treat the cords with a resorcinol formalin latex (RFL) alone or to use the RFL treatment after pretreating the cords with an epoxy or isocyanate compound. It is also known to adhere rubber gum after the RFL treatment.

There are currently in use apparatus through which a cord is continuously drawn off of a supply at a fixed tension and through a supply of adhesive liquid in a dip tank reservoir and moved into an oven in which the adhesive liquid is dried. It is also known to move the treated cord outside of the oven, where it is cooled and subsequently caused to undergo repeated similar processing steps. The subsequent processing steps may be carried out using different processing liquids, different heating temperatures in drying ovens, and different cord tension during processing so as to give the belt the desired optimal properties for incorporation into a power transmission belt. Once the processing is completed, the cord can be continuously accumulated on a take-up unit.

It is known to splice multiple supplies of the cord together so that the overall apparatus can continuously treat the cord without interruption. This can be accommodated at the collection end of the apparatus by incorporating multiple take-up units.

To accommodate this type of continuous operation, it is necessary to keep a sufficient supply of processing liquid in dip tank reservoirs. It is known to provide a bulk supply container in association with each dip tank. High and low level detection switches are provided to automatically control the discharge of the processing liquid from the supply container to the dip tank. An automatic switching valve is closed by one switch when the level reaches a "full" height, with a separate switch being operated to open the switching valve when the liquid reaches a "low level" height.

With this type of system, there may be a significant difference between the "full" and "low" level heights of processing liquid in the dip tanks. As a result, there is a significant difference in immersion time for a continuously advancing cord as it moves through the liquid at the two different heights. The amount of processing liquid adhered to the cord may thus vary from one length to the next. As a result, the cord properties may significantly change from one length to the next.

To avoid a situation where less than the desired amount of processing liquid is adhered to the cord, it is known to keep a surplus amount of processing liquid in the dip tanks. This may result in an increase in the cost of operating the system.

Since the processing liquid solvents may have rubber or resin as a base material, after long periods of operation, these materials solidify. This is particularly a problem around the closing valve, which may become clogged and inoperable or ineffectively operable.

Further, because the processing liquids often contain organic solvents such as toluene, to avoid fire and undesired contact with system operators, it is known to use explosion-proof components on the level switches and closing valves that come in contact with the processing liquid. These modifications often result in increased system size and weight. Further, equipment costs may rise due to all the modifications necessary to make the system operate safely and efficiently. These modifications may make setup, repair, and maintenance, more difficult and costly to perform. Safety compromises may also result in operation and maintenance of these systems.

In recent years, there has been a trend towards having more system flexibility in terms of the processing liquid used and the variation in processing steps. At the same time, there has been a demand for small volume production with this flexibility. Accordingly, the need for a solution to the above-mentioned problems exists.

SUMMARY OF THE INVENTION

In one form of the invention, an apparatus is provided for treating a cord for use in a power transmission belt. The apparatus has a guide system for guiding a cord in a predetermined path and a processing liquid application system including a receptacle for a discrete amount of a processing liquid. A first container defines a reservoir for a supply of processing liquid. There is a discharge opening on the first container for communicating processing liquid from a supply of processing liquid in the first container reservoir to the receptacle. With a first predetermined amount of processing liquid in the receptacle, the predetermined path extends through the processing liquid in the receptacle. With the discharge opening blocked, the first container reservoir is air tight. A first structure is provided for mounting the first container in an operative position on the apparatus wherein processing liquid in the first container reservoir flows by gravity to the discharge opening. With the first container in the operative position and a second amount of processing liquid in the receptacle, the processing liquid in the receptacle blocks the discharge opening on the first container to thereby stop gravitational flow of processing liquid from the first container reservoir to the receptacle. With the first container in the operative position and a third predetermined amount of processing liquid that is less than the second predetermined amount of processing liquid in the receptacle, the discharge opening is unblocked so that processing liquid from the first container reservoir flows through the discharge opening until the processing liquid accumulates in the receptacle to the point that the processing liquid blocks the discharge opening to thereby stop flow of processing liquid through the discharge opening to the receptacle.

The first structure may allow removable mounting of the container in the operative position.

The apparatus has a frame. In one form, the first structure has an inverted, U-shaped bracket on the container that straddles a part of the frame.

The part of the frame may be a cantilevered arm.

A valve can be provided for selectively a) sealing the first container reservoir, and b) allowing processing liquid to flow from the first container reservoir through the discharge opening.

The first container may have a tube-shaped conduit with an upstream end in communication with the first container reservoir and a downstream end at which the downstream opening is defined. The valve may be located between the upstream and downstream ends of the conduit.

In one form, the conduit is rigidly attached to a mounting plate to define with the mounting plate a first subassembly. The first container has a body defining the reservoir, with the first subassembly being removably connected to the container body.

The container body may have a mounting flange to which the mounting plate is bolted.

In one form, the body has a bottom opening communicating with the first container reservoir and the mounting flange extends around the bottom opening in the container and bounds the bottom opening.

A scale can be provided to determine the amount of processing liquid in the first container and give a visual indication to a user of the amount of processing liquid in the first container reservoir.

In one form, the bracket for mounting the first container has a downwardly facing surface that bears on the part of the frame and the scale is interposed between the downwardly facing surface on the bracket and part of the frame and gives an indication of the amount of processing liquid in the first container based upon the force exerted by the downwardly facing bracket surface on the frame part.

A second container can be provided for a supply of processing liquid. The second container defines a second reservoir for a supply of processing liquid and has a discharge opening for communicating processing liquid from a supply of processing liquid in the second reservoir to the receptacle.

In one form, the processing liquid flows from the reservoirs to the receptacle only under its own weight.

The apparatus may further have a heating chamber for heating a cord with processing liquid applied thereto and moving in a predetermined path.

The invention also contemplates the apparatus in combination with a supply of processing liquid in the reservoir.

In another form of the invention, a processing liquid application system for an apparatus for treating a cord in a power transmission belt is provided and has a receptacle for a discrete amount of processing liquid and a first container defining a reservoir for a supply of processing liquid and having a discharge opening for communicating processing liquid from a supply of processing liquid in the first container reservoir to the receptacle. With the discharge opening blocked, the container reservoir is airtight. First structure is provided for mounting the container to a support in an operative position wherein processing liquid in the first container reservoir flows by gravity to the discharge opening. With the first container in the operative position and a first predetermined amount of processing liquid in the receptacle, the processing liquid in the receptacle blocks the discharge opening in the first container to thereby stop gravitational flow of processing liquid from the first container reservoir to the receptacle. With the first container in the operative position and a second predetermined amount of processing liquid, that is less than the first predetermined amount of processing liquid in the receptacle, the discharge opening is unblocked so that processing liquid from the first container reservoir flows through the discharge opening until the processing liquid accumulates in the receptacle to the point that the processing liquid blocks the discharge opening to thereby stop flow of processing liquid through the discharge opening to the receptacle.

The apparatus can be constructed so that the height of the processing liquid in the receptacle varies within only a limited range so that the amount of processing liquid in the reservoir is substantially constant.

By making the container(s) removable, filling thereof and access for maintenance may be facilitated.

Additionally, the need for a complex switching system is avoided, potentially reducing system costs and increasing reliability without compromising safety.

Resultingly, precise treatment of continuously moving cords can be effected.

DETAILED DESCRIPTION OF THE DRAWINGS

Figure 1:
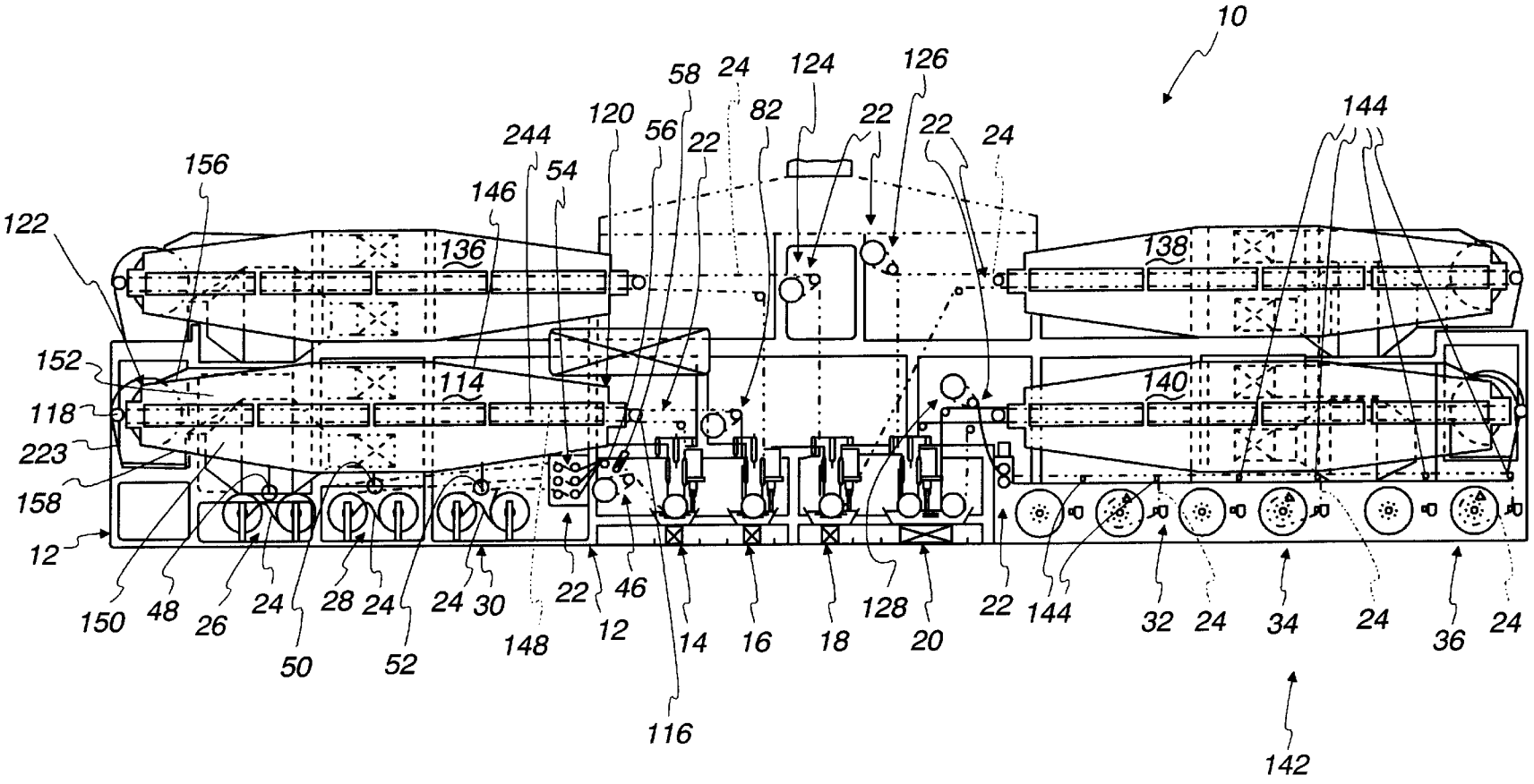
FIG. 1 is a front elevation, partial cross-sectional view of an apparatus for treating cords for use in power transmission belts, according to the present invention.
Figure 2:
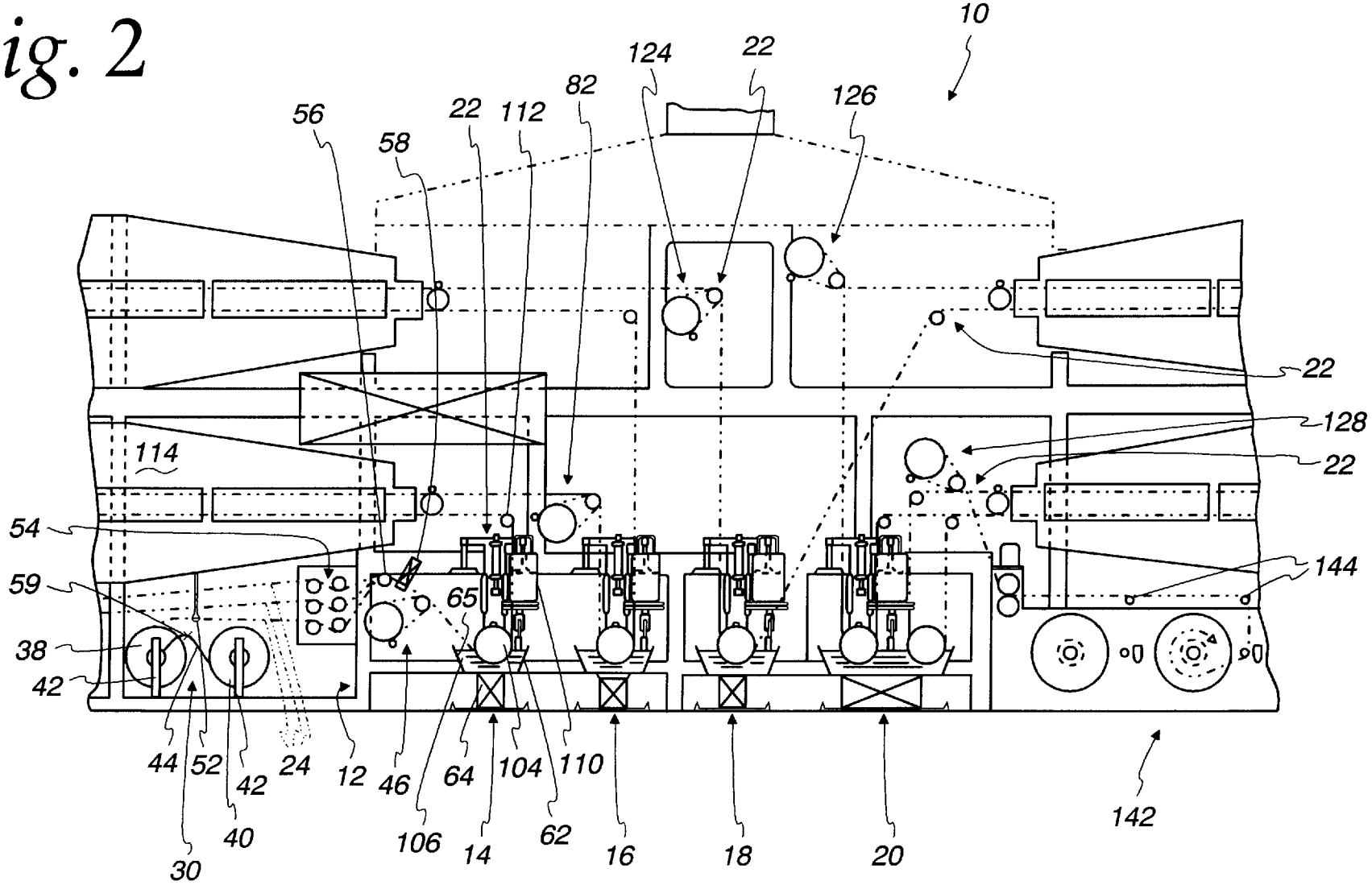
FIG. 2 is an enlarged, fragmentary, front elevation, partial cross-sectional view of a central portion of the apparatus in FIG. 1.

In FIGS. 1 and 2, an apparatus for treating cords for use in power transmission belts, according to the present invention, is shown at 10. The apparatus 10 consists of a frame 12 which supports a processing liquid application system, in this case made up of four dip processing units 14, 16, 18, 20. A guide system 22 guides multiple (in this case three) cords 24, simultaneously from bulk supplies 26, 28, 30 serially through the dip processing units 14, 16, 18, 20 to take-up units 32, 34, 36, at which the processed cords 24 are accumulated. Through the guide system 22, the plurality of cords 24 are simultaneously guided in a like plurality of predetermined paths between the supplies 26, 28, 30 and the take-up units 32, 34, 36.

The bulk supplies 26, 28, 30 are each the same. Exemplary bulk supply 30 consists of separate cheese bobbins 38, 40 supported on a creel stand 42. A leader cord 44 connects to trailing and leading ends on the cords 24 on the cheese bobbins 38, 40.

The cords 24 are simultaneously drawn off of the supplies 26, 28, 30 by a driving roller assembly 46, as seen in FIGS. 1, 2, 4 and 5. Above each supply 26, 28, 30 a support/guide ring 48, 50, 52 is provided, between the supplies 26, 28, 30 and the driving roller assembly 46. Between the support/guide rings 48, 50, 52 and the driving roller assembly 46 are provided pairs of friction tensioners 54 which apply a slight tension to the cords 24. The cords 24, after passing the friction tensioners 54, pass over a guide roller 56. Between the guide roller 56 and the driving roller assembly 46 is a detector 58 which identifies the passing of a splice connection 59 on the cords 24. The detector 58 may be any device suitable for detecting the presence of the splice connection 59. For example, an optical detector could be used for this purpose. The cords 24 progress from the driving roller assembly 46 into a receptacle 65 defined by the dip tank 62 on a support 64 making up the dip processing unit 14.

Figure 4:
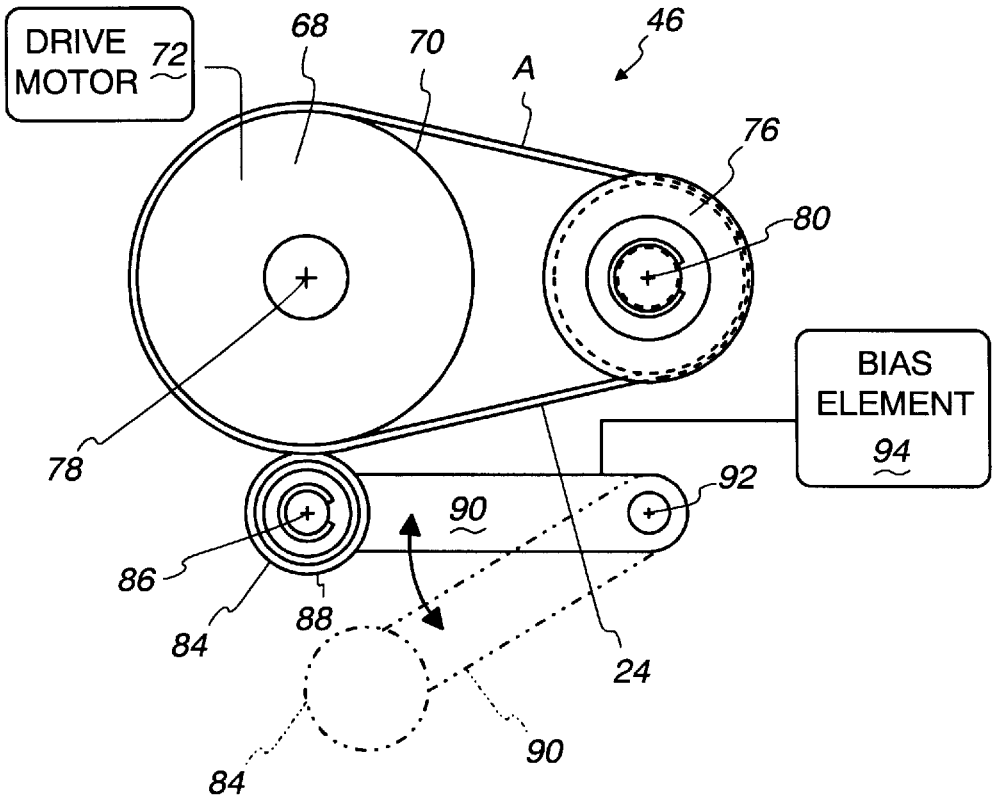
FIG. 4 is an enlarged, fragmentary, front elevation view of a cord driving subassembly on the apparatus in FIGS. 1 and 2.
Figure 5:
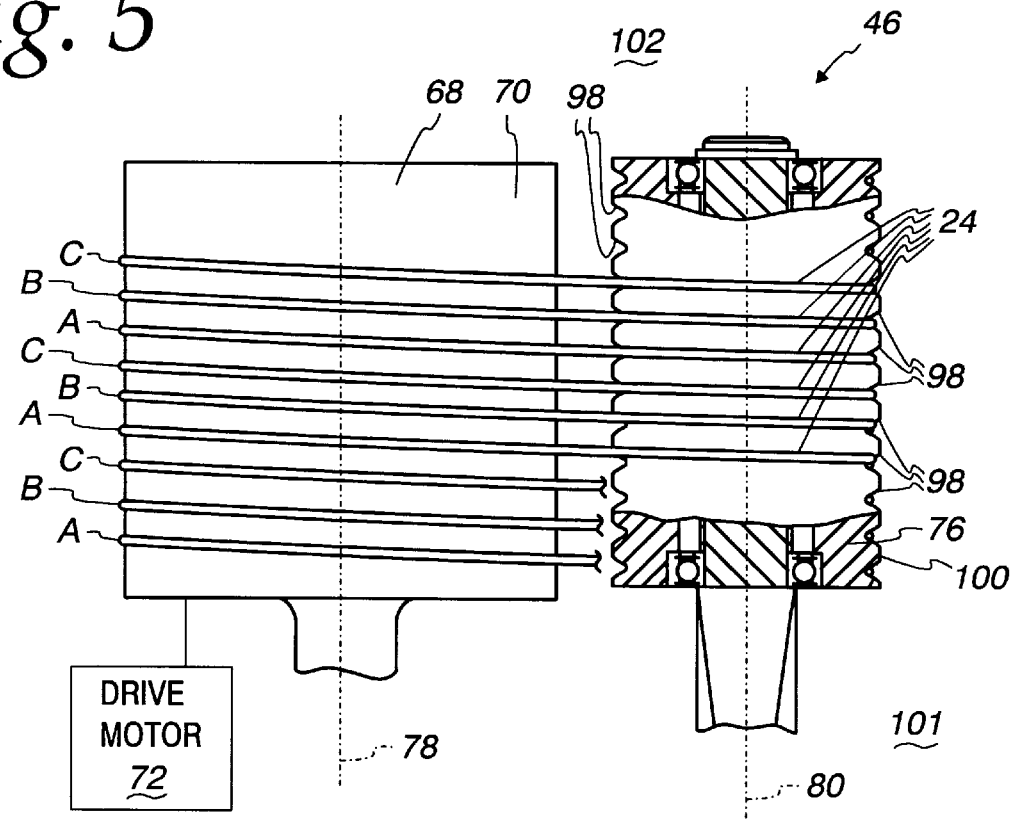
FIG. 5 is a plan view of the cord driving subassembly in FIG. 4.
Figure 6:
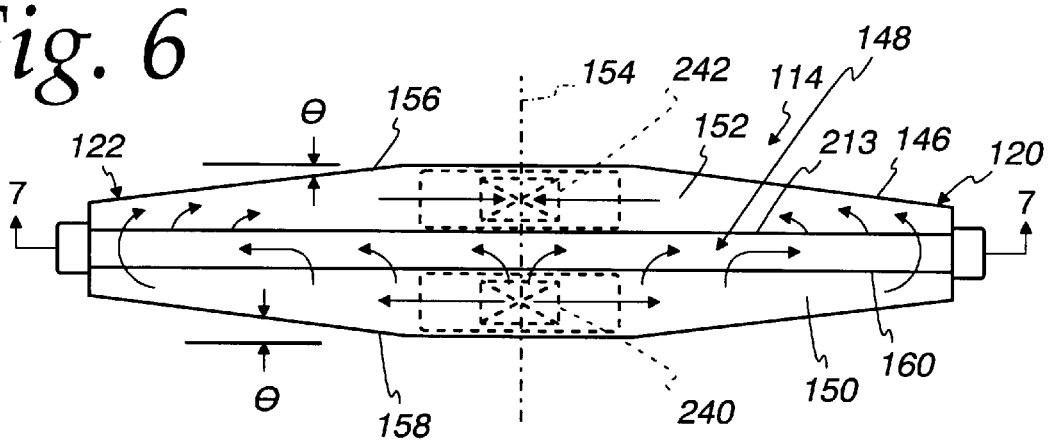
FIG. 6 is an enlarged, front elevation view of a drying oven on the apparatus in FIGS. 1 and 2.
Figure 7:
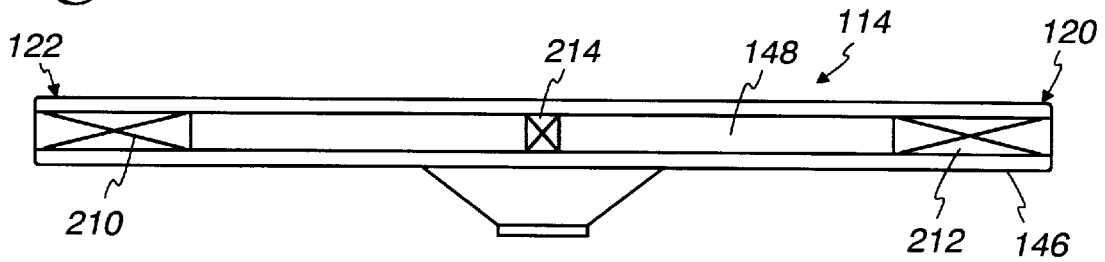
FIG. 7 is a cross-sectional view of the drying oven taken along line 7—7 of FIG. 6.

The driving roller assembly 46, as seen most clearly in FIGS. 4 and 5, consists of a driving roller 68 having a smooth, cylindrical, outer surface 70 that is driven by a variable speed drive motor 72. The driving roller assembly 46 further includes a grooved guide roller 76 situated so that the driving roller 68 and guide roller 76 rotate about spaced, parallel axes 78, 80, respectively. The cords 24, identified as A, B, C, in FIG. 5, are each wrapped several times, in this case three times, around the driving rollers 68 and guide roller 76 to produce a positive frictional force between the cords 24 and the rollers 68, 76. This arrangement also avoids slackening of the cords 24 as a result of a tension produced on the cords 24 through a second driving roller assembly 82 (FIG. 2), downstream of the driving roller assembly 46.

A pinch roller 84 is biasably pressed against the outer surface 70 of the driving roller 68 and presses the cords 24 thereagainst. The pinch roller 84 has a length along its axis 86 sufficient to simultaneously engage all cords 24 wrapped around the drive roller 68. The pinch roller 84 has a cylindrical shape with an outer layer 88 made of a soft resin or rubber. The pinch roller 84 is mounted on an arm 90 which pivots about an axis 92 between solid and phantom line positions in FIG. 4. A bias element 94, such as a spring or a cylinder, urges the arm 90 toward the solid line position in FIG. 4. Normally, the roller 84 is retracted to an open position, shown in phantom lines in FIG. 4. By biasing the roller 84 against the outer surface 70, slackening of the cords 24 is prevented. The roller 84 also prevents shifting of the cords 24 axially along the driving roller 68.

The three cords 24 are fitted one each into spiral grooves 98 formed in the outer surface 100 of the guide roller 76. The grooves 98 have a regular and fixed axially spacing. In this case, each cord 24 is wrapped in a spiral pattern around the rollers 68, 76 in every third groove so that the cords travel in parallel, predetermined spiral patterns around the rollers 68, 76. In the event that fewer than three cords 24 are used, the same pattern is used for the one or two cords 24. For example, if there are two cords 24 used, the A and B cords would move in the same grooves 98, with the grooves 98 being previously occupied by the C cord being empty.

The apparatus 10 has a front side 101 and a rear side 102. The operator of the apparatus 10 resides at the front side 101 of the apparatus 10 to thread the cords 24, inspect the cords 24, fill the dip tank 62, etc. The cords 24 are routed so that they move axially relative to the rollers 68, 76 from the rear side 102 to the front side 101 of the apparatus 10 for ease of maintenance and inspection.

Figure 3:
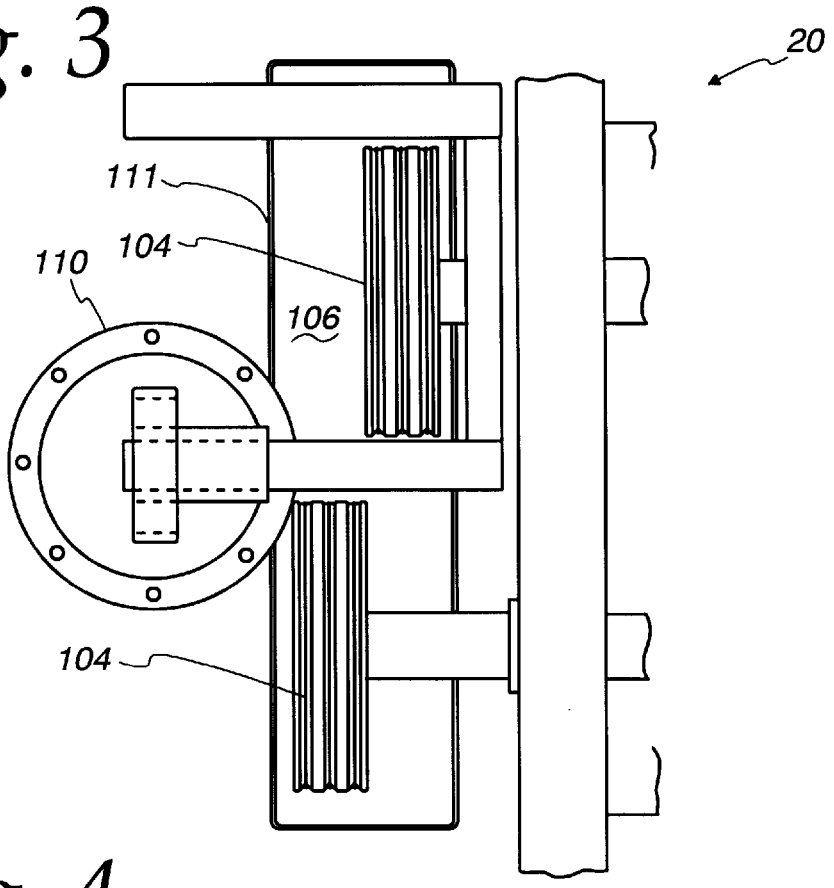
FIG. 3 is an enlarged, fragmentary, plan view of a dip structure for applying a treating substance to a cord on the apparatus in FIGS. 1 and 2.

As seen in FIG. 2, the cords 24 wrap around approximately one-half the circumference of a dip roller 104, which is immersed in a processing liquid 106 in the receptacle 65 defined by the dip tank 62. The liquid supply in the receptacle 65 is continuously replenished by liquid in a storage tank/container 110, which keeps the level of liquid in the tank 62 substantially constant at a predetermined level. In FIG. 3, the dip processing unit 20 is shown with two dip rollers 104 in a wider tank 111 in which processing liquid 106 is retained and supplied from a like storage tank/container 110. In this unit 20, dip processing takes place two times, whereas dip processing takes place only one time in each of the other units 14, 16, 18.

As seen in FIGS. 1 and 2, from the dip tank 62, the cords 24 move upwardly and wrap around approximately one-quarter of the circumference of a guide roller 112 and then move horizontally into an elongate drying oven 114. As described in greater detail below, the cords 24 are caused to move back and forth several times within the drying oven 114 between rollers 116, 118 at the ends 120, 122 of the drying oven 114. In the oven 114, the cords 24 are heated to dry the liquid 106 applied thereto. The cords 24 are cooled in the atmosphere as they discharge from the drying oven at the oven end 120. The cords 24 exiting the drying oven 114 move to the second driving roller assembly 82, which is likewise operable selectively at different speeds. The speed of the second driving roller assembly 82 is determined by monitoring the speed of the driving roller assembly 46 and matching the speed of the second driving roller assembly 82 to that of the driving roller assembly 46. Third, fourth, and fifth downstream driving roller assemblies 124, 126, 128 also have speed control capabilities incorporated therein. The speed of each driving roller assembly 124, 126, 128 is monitored and matched to the speed of the immediately upstream driving roller assembly 124, 126.

The apparatus 10 can be used to process the cords 24 in a number of different manners. The precise manner selected depends upon the nature of the substance being applied to the cords 24. For example, different forms of processing liquid can be used, i.e. pre-dip liquid, RFL liquid, and soaking liquid. Different drying temperatures and cord tensions can be chosen as well. In this case, three additional dip processing units 16, 18, 20 are provided downstream of the dip processing unit 14. The cords 24 can be dip processed in any one or all of the dip processing units 14, 16, 18, 20 followed by heat treating in the drying oven 114 and/or one or all of the additional three ovens 136, 138, 140 downstream of the oven 114. The invention contemplates that a single dip processing procedure, up to four dip processing procedures, can be carried out followed by heat treating in one to four of the ovens 114, 136, 138, 140, followed by cooling outside of the ovens 114, 136, 138, 140.

After dip processing and heating, the cords 24, as seen in FIGS. 1 and 2, are directed to the take-up units 32, 34, 36. In the take-up section 142 of the apparatus 10, the cords 24 pass over six guide rollers 144 and from there are directed for accumulation on the take-up units 32, 34, 36.

Each oven 114, 136, 138, 140 is substantially the same in construction and uses a forced air, indirect heating. Exemplary oven 114 will now be described with respect to FIGS. 1 and 6–10. The oven 114 has a housing 146 defining an internal air flow space. The housing 146 has an internal heating/drying chamber 148 through which the cords 24 pass during treatment. Beneath the heating/drying chamber 148 is a hot air supply chamber 150 which communicates with the heating/drying chamber 148. A hot air recovery chamber 152 is located above, and communicates with, the heating/drying chamber 148. Incoming heated air is communicated from the hot air supply chamber 150 to the heating/drying chamber 148 to the hot air recovery chamber 152.

The housing 146 and chambers 148, 150, 152 are substantially symmetrical about a vertical plane 154. The heating/drying chamber 148 has a substantially uniform cross section. Each of the chambers 150, 152 has a substantially uniform cross section in the vicinity of the center plane 154 and tapers progressively toward each of the ends 120, 122 of the oven 114. The angle θ of inclination of the top wall 156 and bottom wall 158 is between 5–30°. This arrangement causes a uniform flow speed of hot air travelling through the hot air supply chamber 150 and hot air recovery chamber 152 so as to prevent combustible gas, such as toluene, from stagnating at locations in the hot air supply chamber 150 and hot air recovery chamber 152.

The sloping arrangement of the top and bottom walls 156, 158 also provides useable space, as to facilitate compact nesting of other components, such as the bulk cord supplies 26, 28, 30, the take-up units 32, 34, 36, control panels, and other components. This makes possible the designing of a compact, overall system.

A partition 160 separates the hot air supply chamber 150 from the heating/drying chamber 148. The partition 160 has a plurality of slit-shaped openings/slits 162 therethrough which extend in parallel relationship for substantially the entire length of the oven 114 between the ends 120, 122 thereof. The slit-shaped openings 162 are provided on the rear side 163 of the oven 114 at which the cords 24 enter. In the embodiment shown, the openings 162 are provided over approximately one-half the front to rear dimension of the oven 114. Through this arrangement, the heated air can be concentrated on the incoming cords 24 which have undried processing liquid 106 thereon. The slit-shaped openings 162 are defined between vertically extending flat surfaces 164, 166 on adjacent, spaced partitions 168. The cords 24 are centered in a front to rear direction between the surfaces 164, 166 so that the heated air is funnelled thereby to directly against the cords 24. The hot air blown through the openings 162 is normally moving at a speed of 5–30 meters per second. Preferably, the width of the slit-shaped openings (W) is 3–10 mm, with the spacing of the openings being 5–30 mm.

The guide rollers 116, 118 are disposed outside of the drying oven 114 adjacent to the ends 120, 122 thereof. The incoming cords 24 move in a first straight line path portion at 174. The cords 24 depart the drying oven 114 in a path portion at 176 that is substantially straight and parallel to the path portion at 174. Between the rollers 116, 118, the cords 24 move in substantially straight paths generally parallel to the length of the oven 114 between the ends 120, 122 thereof. More particularly, the cords 24 pass under the rollers 116, 118 as they enter the oven 114 to be in close proximity to the heated air from the hot air supply chamber 150. The cords 24 wrap approximately 180° around the roller 118 and extend over and then under the roller 116, wrapping through approximately 180°. The cords 24 continue this wrapping motion, wrapping over and under the roller 116 three times and under and over the roller 118 four times between the time that they enter and depart from the heating/drying chamber 148. The system is configured so that the cords 24 shift from rear to front an amount equal to the total number of cords ×1 pitch dimension for each passage between the rollers 116, 118. In each wrapping motion, the cords 24 contact the rollers 118, 116 through approximately 180°. The cords 24 moving in their respective paths move progressively from the rear 102 to the front 101 of the oven 114 as the rollers 116, 118 are rotated around their respective axes 178, 180. In this manner, each of the cords 24 moves spirally in a predetermined pattern, with the cords 24 remaining substantially parallel to each other through the heating/drying chamber 148. With this arrangement, each cord 24 is caused to pass back and forth within the heating/drying chamber 148 several times, including multiple passes directly over the slit-shaped openings 162.

The roller 118 consists of a shaft 182 upon which one roller element 184, having one configuration, and three roller elements 186 having a different configuration than the one roller 184, are coaxially mounted for rotation on bearings 188 interposed between the roller elements 184, 186 and the shaft 182. The roller elements 184, 186 have an axial dimension chosen so that they will each simultaneously accommodate the number (in this case three) of cords 24 simultaneously advanced through the apparatus 10. That is, each of the three cords 24 reside at all times on each of the roller elements 184, 186 so that the cord tension is uniform within the heating/drying chamber 148. Grooves 190, 192 are defined in the annular outer surfaces 193, 194 of the roller elements 186 and roller 116 at a predetermined spacing, with their being one cord 24 fitted in each groove 190, 192 as the system is operated. This maintains the desired parallel alignment of the cords 24 as they travel through the heating/drying chamber 48 in their predetermined paths. The roller element 184 has an annular outer surface 196 that is flat i.e. without grooves.

Immediately upstream of the roller element 184 is a cord separator 198. The cord separator 198 consists of a mounting plate 200 from which strategically located pins 202, 204, 206, 208 project upwardly in a zig-zag pattern. The pins 202–208 are spaced 20–30 mm in the lengthwise direction of the drying oven 114. With this arrangement, the pin pairs 202, 204; 202, 206; 206, 208 cooperate to align and guide the moving cords 24. With this arrangement, the splice connection 59 on the cords 24 will move without hangup through the cord separator 198.

The smooth surface 196 of the roller element 184 resists buildup of the processing liquid 106 with which the cords 24 are treated. Any of the liquid that does transfer to the surface 196 tends to disperse, rather than accumulate, thereby extending the running period for the apparatus 10 before regular maintenance of the guide roller 118 is required. Additionally, maintenance is facilitated by reason of the fact that the roller element 184 can be slid along the shaft 182 relative to the cords 24 without having to remove the cords 24.

Heated air from the heating/drying chamber 148 is communicated to the hot air recovery chamber 152 through openings 210, 212 at the ends 120, 122 of the drying oven 114 extending through a partition separating the heating/drying chamber 148 from the hot air recovery chamber 152. The combined area of the openings 210, 212 is selected to be substantially equal to the combined area of the slit openings 162 through the partition 160 to cause even air flow. To adjust the temperature distribution in the heating/drying chamber 148, it is possible to use an auxiliary opening 214 between the openings 210, 212.

Figure 8:
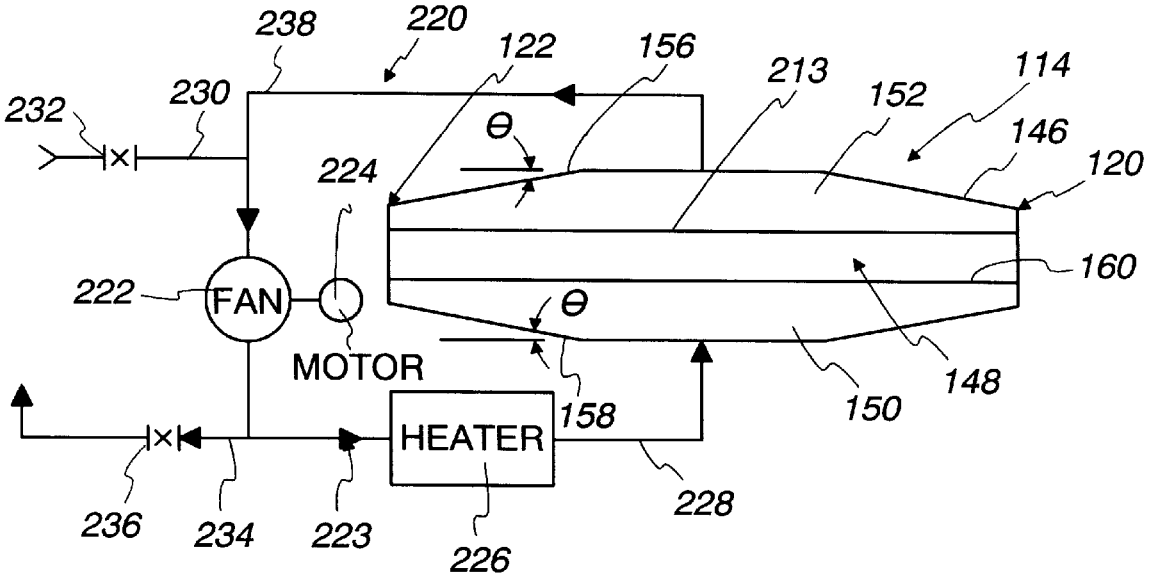
FIG. 8 is a schematic representation of a system for circulating heated air in the drying oven in FIG. 7.
Figure 10:
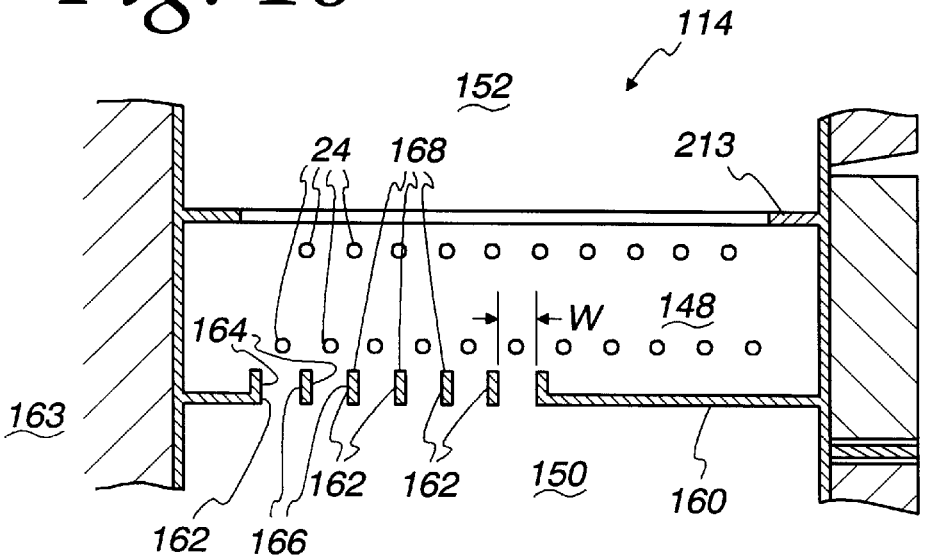
FIG. 10 is an enlarged, cross-sectional view of the drying oven taken along line 10—10 of FIG. 9.
Figure 9:
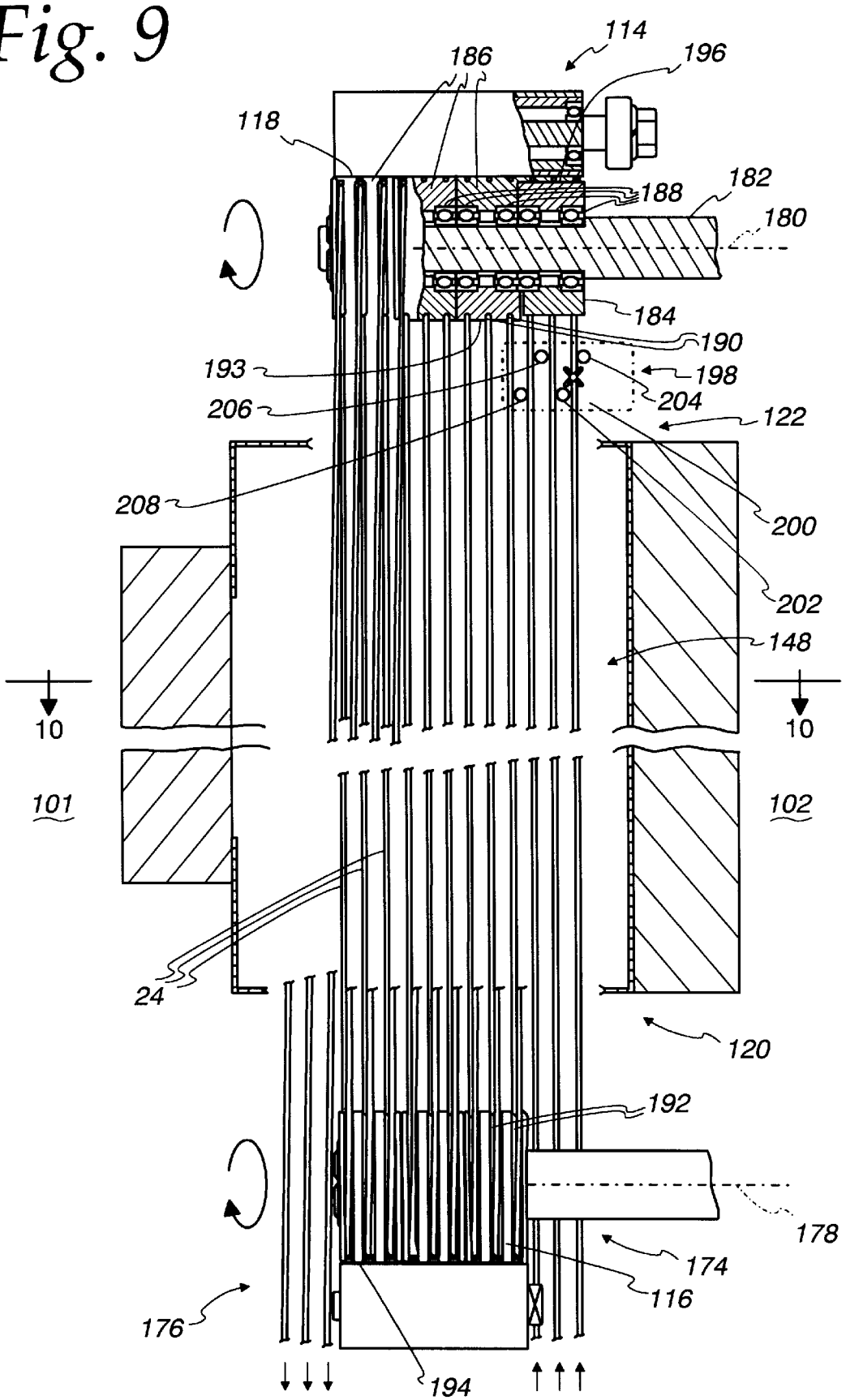
FIG. 9 is an enlarged, fragmentary, partial cross-sectional view of the drying oven in FIGS. 7 and 8 with cords being directed therethrough.
Figure 11:
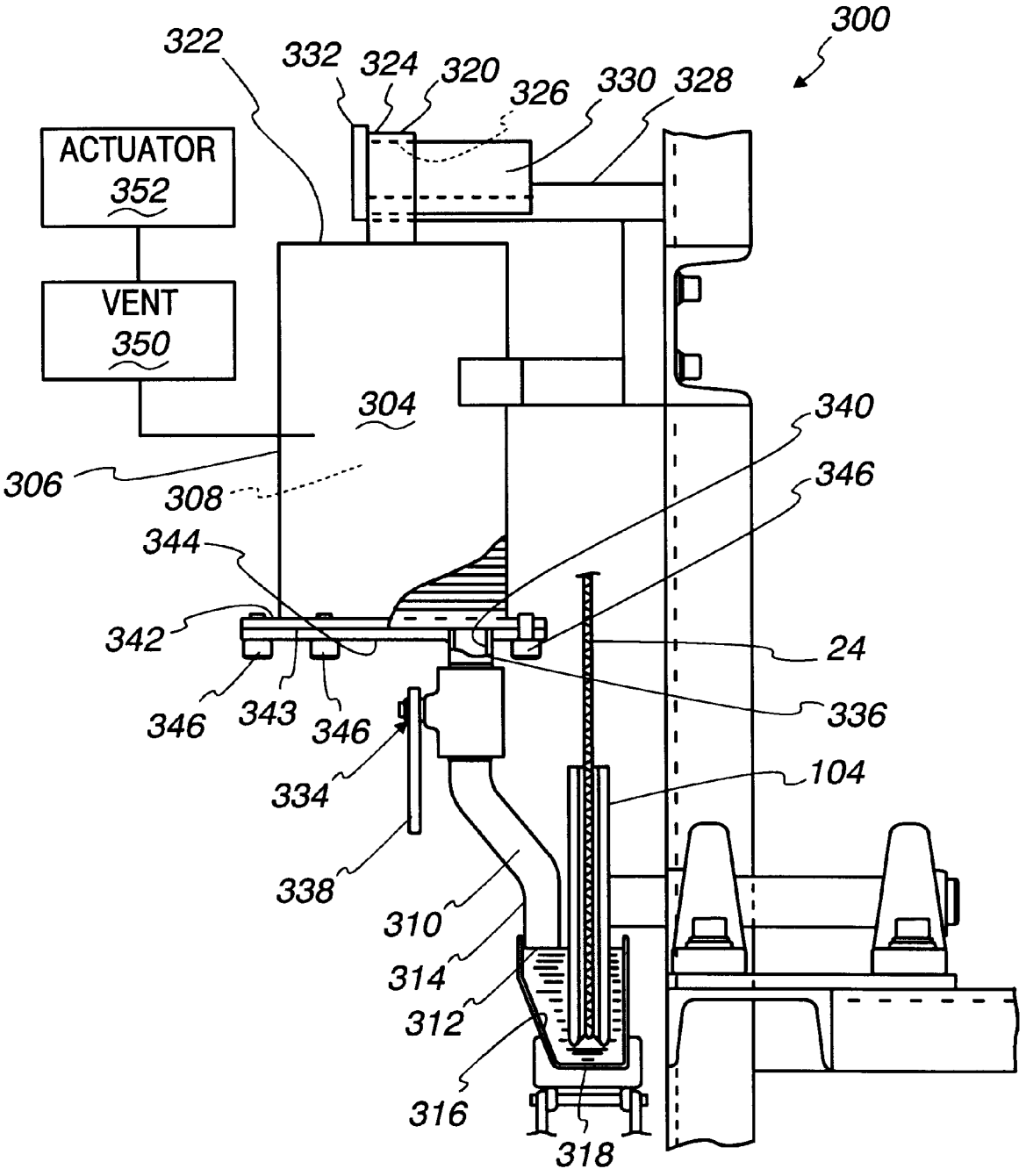
FIG. 11 is a fragmentary, side elevation view of a modified form of dip structure for applying a substance to a cord for use on the apparatus in FIGS. 1 and 2.
Figure 12:
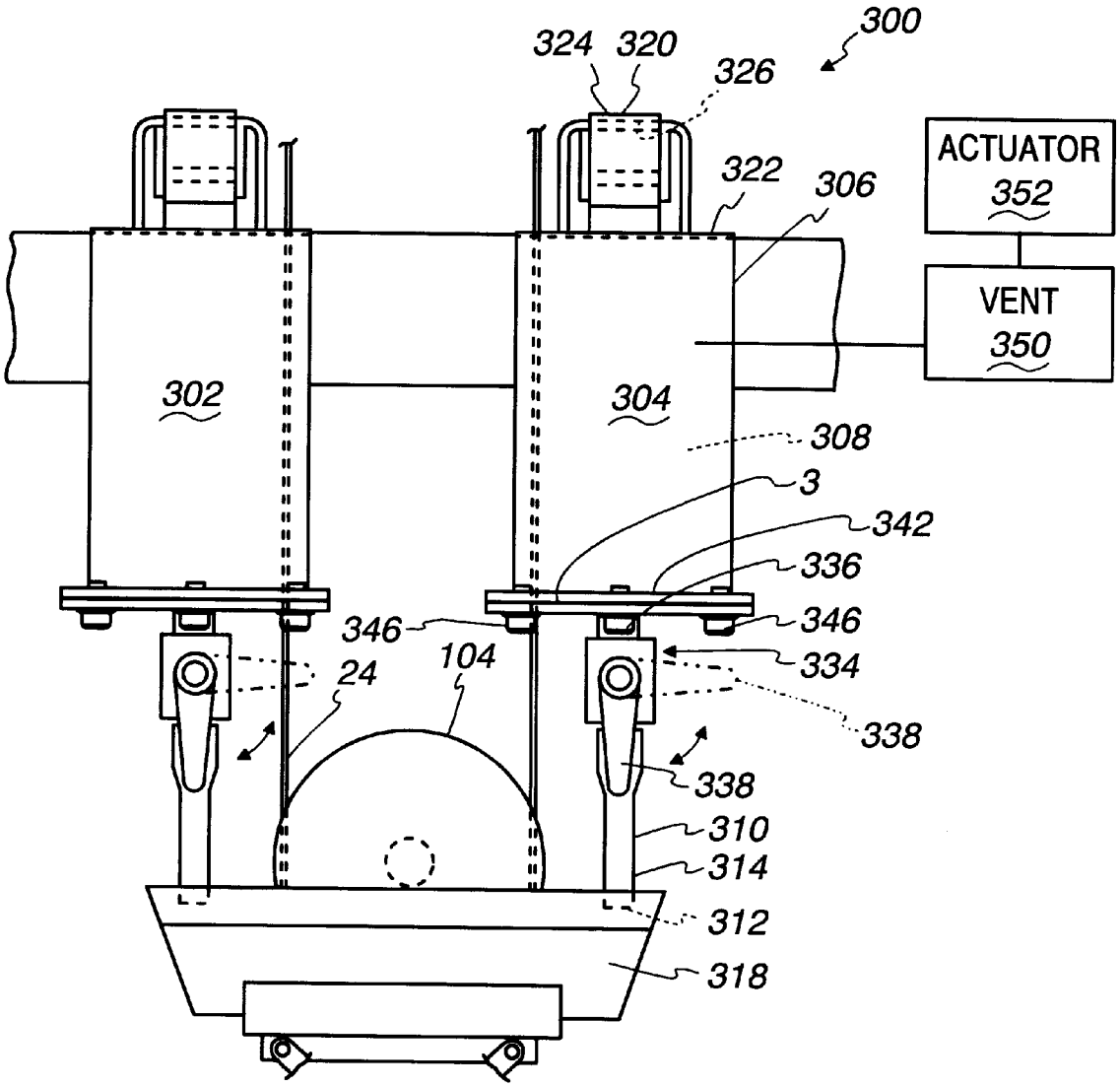
FIG. 12 is a fragmentary, front elevation view of the dip structure of FIG. 11.

A hot air circulating system for the drying oven 114 is shown at 220 in FIG. 8. The system 220 includes an air moving element/fan 222 in a duct system 223, which fan is operated by an electric motor 224. Air is forced by the fan 222 through a heater 226. Air heated by the heater 226 is directed through a conduit 228 into the hot air supply chamber 150. Outside air can be controllably delivered to the fan 222 through a conduit 230 which has an in-line damper 232. Air delivered by the fan 222 can be partially exhausted to the atmosphere through a conduit 234 controlled by an in-line damper 236. Air passing through the heating/drying chamber 148 to the hot air recovery chamber 152 is returned to the fan 222 via a conduit 238 to complete the circulation loop. The dampers 232, 236 can be manually operated or can be automatically operated in response to a pressure differential between the atmosphere and the system loop. Additional ventilation can be provided in conventional fashion between the interior of the housing 146 and the atmosphere.

In operation, heated air from the conduit 228 is delivered from the conduit 228 through an inlet opening 240 in the housing 146. The heated air branches from the opening 240 towards both ends 120, 122 of the drying oven 114. The tapering configuration of the chamber 150 avoids pressure reduction at the ends 120, 122 so that with a uniform incoming air speed, the heated air is propelled forcibly through the slit openings 162. By having the hot air flow into the heating/drying chamber 148 from the ends 120, 122, a uniform heating of the chamber 148 takes place.

The hot air blowing through the slit openings 162 travels vertically against the wet cords 24 and then branches laterally towards the ends 120, 122 from where it is discharged through the openings 210, 212 into the hot air recovery chamber 152. This accounts for a uniform heating of the cords 24 in the heating/drying chamber 148 while at the same time preventing combustible gases such as toluene from stagnating anywhere within the housing 146.

From the hot air recovery chamber 152, the air discharges from the housing 146 through an opening 242, which communicates with the conduit 238 for delivery back to the fan 222. The dampers 232, 234 are adjusted to control communication of air from the system to the atmosphere and from the atmosphere to the system. The concentration of combustible gas resulting from the vaporization of toluene or the like, used as a solvent in the processing liquid, is thus reduced, as a result of which system safety is enhanced.

The preferred forms of the processing liquid application system, according to the present invention, are shown in FIGS. 11–14. A dip processing unit, according to the present invention, is shown at 300 in those Figures. The dip processing unit 300 could be substituted for any one, or all, of the dip processing units 14, 16, 18 in FIG. 1. The dip processing unit 300 has first and second containers 302, 304. The containers 302, 304 are the same in structure and function with exemplary container 304 being described in detail below.

The container 304 has a body 306 defining an internal reservoir 308 for holding a discrete amount of processing liquid. A tube-shaped conduit 310 communicates between the reservoir 308 and a discharge opening 312 at the downstream end 314 of the conduit 310.

The container 304 is mounted in an operative state on the frame 12 so that the discharge opening 312 on the conduit 310 resides within a receptacle 316 defined by a tank 318. The amount of processing liquid 106 in the receptacle 316 is ideally such that approximately one-half of the circumference of the dip roller 104, which advances the cords 24 into and out of the receptacle 316 as the cords 24 move in their predetermined paths, is immersed in the processing liquid 106.

The container 34 includes a mounting bracket 320 that is generally U-shaped, as viewed from the front of the container 34. The mounting bracket 320 projects from an upper wall 322 of the container body 306 and functions as a hanger for the container 304. More particularly, the base 324 of the U-shaped bracket 320 has a downwardly facing surface 326 which bears against a cantilevered arm 328 on the frame 12. A spacer 330 can be interposed between the bracket 320 and the arm 328 and has an enlarged end 332 to limit forward shifting of the bracket 320 and container 304 relative to the frame 12.

A valve 334 is provided in the conduit 310 between the upstream end 336 and the downstream end 314 of the conduit 310. Through an operating handle 338, the valve 334 is changed between an open state, with the handle 338 in the solid line position of FIG. 12, and a closed state, with the handle 338 in the phantom line position of FIG. 12. The valve 334 has a conventional construction and, in its open state, allows processing liquid in the reservoir 308 to flow gravitationally to an outlet opening 340 at the bottom of the body 306 to and through the conduit 310 to the discharge opening 312 and into the receptacle 316. With the valve 334 closed, flow through the conduit 310 is fully blocked and the reservoir 308 is thereby sealed in an airtight manner.

For convenience of assembly and maintenance, the body 306 has a peripheral mounting flange 342 with a downwardly facing surface 343. The upstream end 336 of the conduit 310 is rigidly connected to a mounting plate 344, with the mounting plate 344 and conduit 310 defining a subassembly which is releasably attachable to the mounting flange 342 through bolts 346. A sealing gasket 348 (FIG. 12) may be sandwiched between the mounting flange 342 and mounting plate 344. The mounting flange 342 is designed so that with the mounting plate 344 removed, substantially the entire inside surface of the body 306 bounding the receptacle 316 is exposed, to be readily inspected and cleaned.

By lifting the container 304 from the operative state, the bracket 320 will clear the enlarged spacer end 332 to allow the container 304 to be fully separated from the frame 12. Once this occurs, the mounting bracket 320 functions as a handle to facilitate transportation of the container 304.

By inverting the container 304 from the operative state, processing liquid can be directed into the receptacle 316 through the discharge opening 312 with the valve 334 in the open state. Once a predetermined amount of processing liquid is directed into the container reservoir 308, the valve 334 is closed. The container 304 is then righted and hung upon the arm 328 through the mounting bracket 320, with the downstream conduit end 314 residing in the receptacle 316.

By then opening the valve 334, processing liquid is allowed to flow from the reservoir 308 through the conduit 310 into the receptacle 316. The length of the conduit 310 is chosen so that the discharge opening 312 resides at the optimum height for the processing liquid in the receptacle 316.

With the container 304 in the operative position and a first predetermined amount of processing liquid in the receptacle 316, the discharge opening 312 is immersed in the processing liquid, thereby creating a liquid seal at the discharge opening 312. Since the contiguous space within the conduit and the reservoir 308 is sealed by the liquid 106, this space is airtight and thus negative pressure is created in the container 304 that precludes outflow of processing liquid 106. After a certain operating period, the amount of processing liquid 106 in the receptacle 316 diminishes to a second predetermined amount, whereupon the discharge opening 312 becomes exposed. As a result, the vacuum within the container 304 is broken and processing liquid 106 flows out, progressively filling the receptacle 316 to the point that the discharge opening 312 once again becomes sealed. The conduit end defining the discharge opening 312 can be configured so that the level of the processing liquid 106 within the receptacle 316 varies only slightly between the "flow" and "no flow" states. Accordingly, the exposure time of the cords 24 through the processing liquid 106 in the receptacle 316 remains at all times relatively constant.

By using the containers 302, 304 in tandem, one container 302, 304 at a time can be activated. When the supply in one of the containers 302, 304 diminishes significantly, the other container 302, 304 can be activated. The container 302, 304 with the diminished supply can then be closed, refilled, and replaced in the operative position to be actuated when the supply of processing liquid 106 in the then active container 302, 304 is diminished.

To facilitate liquid flow, a vent 350 can be provided to communicate between the reservoir 308 and the atmosphere. The vent 350 can be selectively opened and closed through an appropriate actuator 352.

Figure 13:
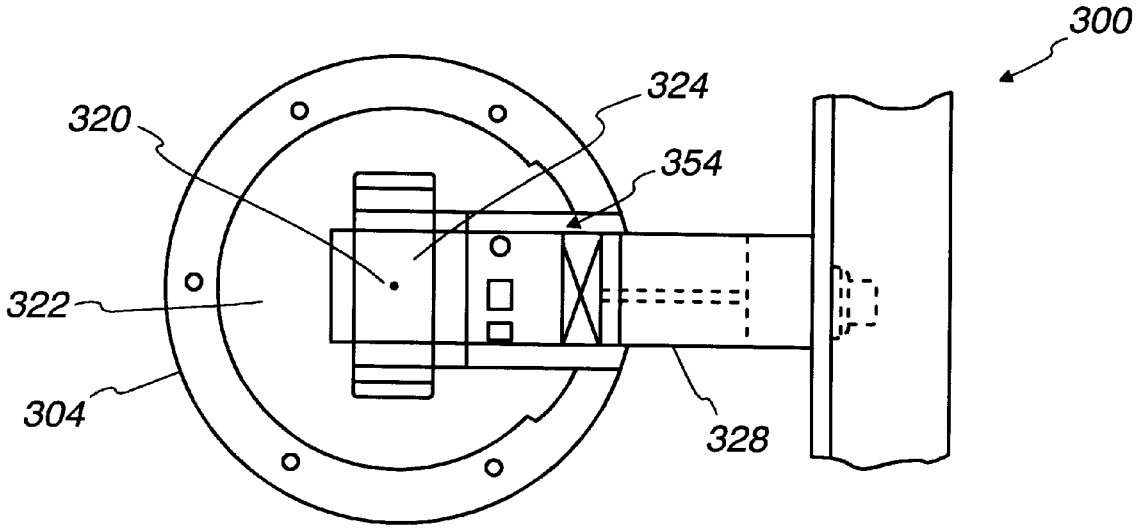
FIG. 13 is a fragmentary, plan view of a further modified form of dip structure for applying a substance to a cord, according to the present invention, for use on the apparatus in FIGS. 1 and 2.
Figure 14:
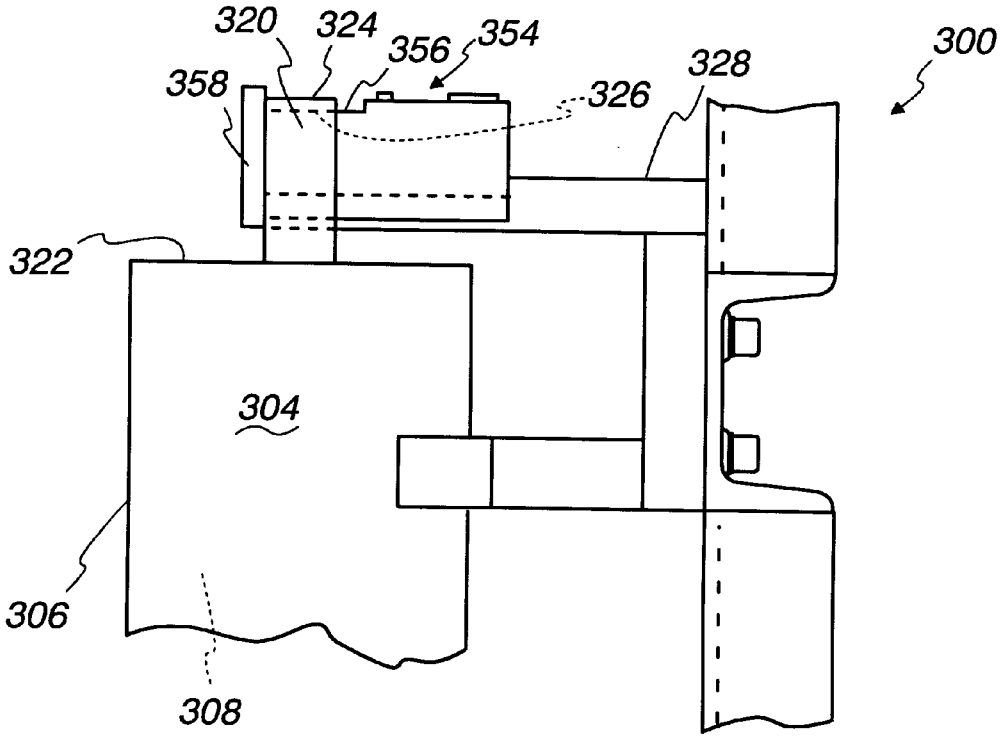
FIG. 14 is a fragmentary, side elevation view of the dip tank in FIG. 13.

To facilitate monitoring of the amount of processing liquid in the containers 302, 304, a scale 354 may be incorporated as part of the previously described spacer 230, as shown in FIGS. 13 and 14. The scale 354 has a seat 356 for the bracket 320 and an enlarged end 358, the same as the spacer 330. The scale 354 is mounted upon the arm 328 in the same manner as the spacer 330. The scale 354 may have a built-in distortion resistance-type converter, of well known construction. The scale 354 identifies for the user the amount of processing liquid 106 through a weight measurement, i.e. downward force exerted by the container 304.

By pre-weighing the empty container 302, 304, the amount of processing liquid 106 can be determined by a) identifying the combined weight of the container 302, 304 and processing liquid and b) determining the difference between the combined weight and the empty weight of the container 302, 304.

Through this arrangement, it is possible to exhaust substantially the entirety of the processing liquid in one of the containers 302, 304 before activating the other container 302, 304, thereby minimizing maintenance time for the apparatus. The container 110 on the dip unit 20 in FIG. 10 can be mounted and operated in the same manner as the containers 302, 304, described above.

The foregoing disclosure of specific embodiments is intended to be illustrative of the broad concepts comprehended by the invention.

We claim:

1. An apparatus for treating a cord for use in a power transmission belt with a processing liquid, said apparatus comprising:

a guide system for guiding a cord in a predetermined path; and a processing liquid application system, said processing liquid application system comprising a receptacle for a discrete amount of a processing liquid and first and second containers mounted in an operative position with each defining a reservoir for a supply of processing liquid, there being a discharge opening on the first and second containers that resides within the receptacle with each of the first and second container in the operative position; a scale means for determining and providing a visual indication of the amount of processing liquid in the first and second container; and processing liquid from the respective container reservoir communicating by gravity through its respective discharge opening to the receptacle, wherein with a first predetermined amount of processing liquid in the receptacle, the predetermined path extends through the processing liquid in the receptacle so that the cord moving in the predetermined path is treated with the processing liquid, wherein with the respective discharge opening blocked, the respective container reservoir is air tight;

wherein with the respective container in the operative position and a second predetermined amount of processing liquid in the receptacle, the processing liquid in the receptacle blocks the respective discharge opening on the respective container to thereby stop gravitational flow of processing liquid from its respective container reservoir to the receptacle, wherein with the respective container in the operative position and a third predetermined amount of processing liquid that is less than the second predetermined amount of processing liquid in the receptacle the respective discharge opening is unblocked so that processing liquid from the respective container reservoir flows through the respective discharge opening until the processing liquid accumulates in the receptacle to the point that the processing liquid blocks the respective discharge opening to thereby stop flow of processing liquid through the respective discharge opening to the receptacle whereby one may alternatively switch from one of the respective containers to the other of the respective containers to supply the processing liquid to the receptacle based on the visual indication of the scale.

2. The apparatus for treating a cord according to claim 1 wherein the first container is removably mounted in the operative position.

3. The apparatus for treating a cord according to claim 2 wherein the apparatus comprises a frame and there is an inverted U-shaped bracket on the first container that straddles a part of the frame to thereby mount the first container in the operative position and the U-shaped bracket is separable from the frame.

4. The apparatus for treating a cord according to claim 3 wherein the part of the frame comprises a cantilevered arm.

5. The apparatus for treating a cord according to claim 1 including a valve for selectively a) sealing the first container reservoir and b) allowing processing liquid to flow from the first container reservoir to and through its respective discharge opening.

6. The apparatus for treating a cord according to claim 5 wherein the first container has a tube-shaped conduit having an upstream end in communication with the first container reservoir and a downstream end at which its respective discharge opening is defined.

7. The apparatus for treating a cord according to claim 6 wherein the valve is on the conduit between the upstream and downstream ends of the conduit.

8. The apparatus for treating a cord according to claim 1 wherein the first container includes a tube-shaped conduit which communicates processing liquid from the first container reservoir to its respective discharge opening, the conduit being rigidly attached to a mounting plate to define with the mounting plate a first subassembly, the first container has a body defining the reservoir, and the first subassembly is removably connected to the container body.

9. The apparatus for treating a cord according to claim 8 wherein the first container body has a mounting flange and the mounting plate is bolted to the mounting flange.

10. The apparatus for treating a cord according to claim 8 wherein the first container body has a bottom opening communicating with the first container reservoir and the mounting flange extends around the bottom opening in the first container and bounds the bottom opening.

11. The apparatus for treating a cord according to claim 1 wherein the apparatus comprises a frame, there is a bracket on the respective container that has a downwardly facing surface that bears on a part of the frame, and the scale is interposed between the downwardly facing surface on the bracket and the part of the frame and gives an indication of the amount of processing liquid in the respective container based upon a force exerted by the downwardly facing bracket surface on the frame part.

12. The apparatus for treating a cord according to claim 1 wherein the processing liquid flows from the first container reservoir to the receptacle only under its own weight.

13. The apparatus for treating a cord according to claim 1 wherein the apparatus further comprises a heating chamber for heating the cord having the processing liquid applied thereon.

* * * * *